United States Patent [19]

Bruder et al.

[11] 4,249,489

[45] Feb. 10, 1981

[54] MULTI-CYLINDER INTERNAL COMBUSTION ENGINE WITH A VALVE SHUTOFF

[75] Inventors: Werner Bruder, Remseck; Roland Merkle, Stuttgart, both of Fed. Rep. of Germany

[73] Assignee: Daimler-Benz Aktiengesellschaft, Fed. Rep. of Germany

[21] Appl. No.: 22,326

[22] Filed: Mar. 20, 1979

[30] Foreign Application Priority Data

Apr. 1, 1978 [DE] Fed. Rep. of Germany ..... 2814096

[51] Int. Cl.[3] ..... F01L 13/00; F02D 13/06

[52] U.S. Cl. ..... 123/90.16; 123/90.27; 123/90.32; 123/198 F

[58] Field of Search ..... 123/198 F, 90.15, 90.16, 123/90.27, 90.32

[56] References Cited

U.S. PATENT DOCUMENTS

| | | | |
|---|---|---|---|
| 1,977,778 | 10/1934 | Rice | 123/198 F |
| 2,948,274 | 8/1960 | Wood | 123/90.16 |
| 4,050,435 | 9/1977 | Fuller, Jr. et al. | 123/198 F |
| 4,114,588 | 9/1978 | Jordan | 123/90.46 |
| 4,167,931 | 9/1979 | Lizuha | 123/90.46 |
| 4,173,209 | 11/1979 | Jordan | 123/198 F |
| 4,175,534 | 11/1979 | Jordan | 123/198 F |

*Primary Examiner*—Ira S. Lazarus

*Attorney, Agent, or Firm*—Craig & Antonelli

[57] ABSTRACT

A multi-cylinder internal combustion engine with a valve shutoff. A mechanical device in which is integrated a valve clearance compensation arrangement, is interposed between an end of the valve stem and the valve actuating arrangement. A mechanical device includes a cup tappet and serves respectively arbitarily in one case as a rigid connecting member between the end of the valve stem and the valve actuating arrangement and, in the other case, during a closed position of the valve, eliminates the connection between the end of the valve stem and the valve actuating arrangement.

23 Claims, 2 Drawing Figures

MULTI-CYLINDER INTERNAL COMBUSTION ENGINE WITH A VALVE SHUTOFF

Figure 1:
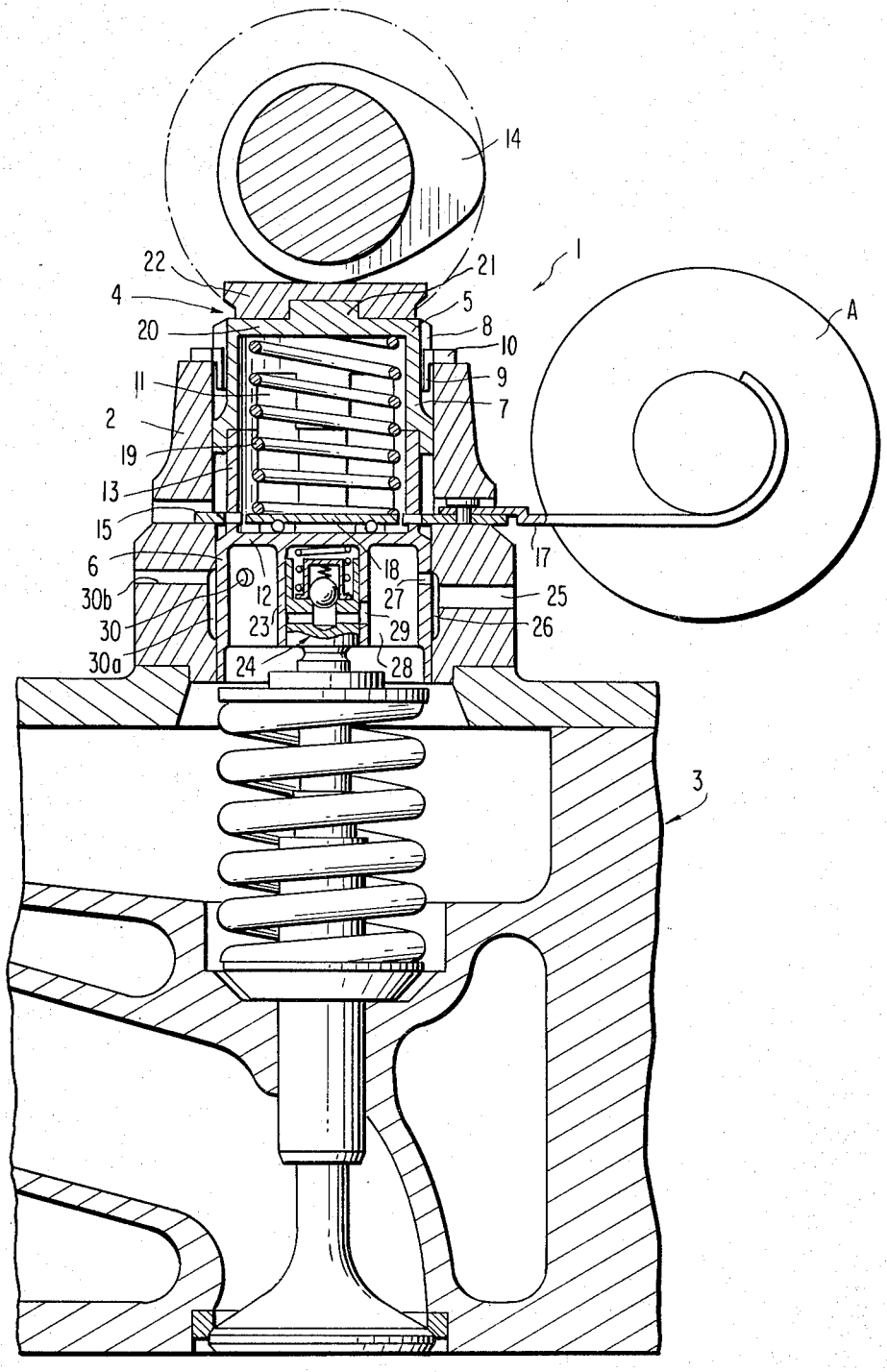

The present invention relates to a multi-cylinder internal combustion engine which is provided with a valve shutoff means.

In order to reduce fuel consumption of an internal combustion engine during, for example, a partial load range, it has been proposed to disconnect or inactivate one or several cylinders of the internal combustion engine by shutting off the valves of such cylinders. The reasoning behind the inactivation of certain cylinders of the multi-cylinder engine is that the still operative remainder of the cylinders operate at a higher average pressure and, a higher average pressure results in a lower specific fuel consumption which can be determined from usual consumption characteristics of a reciprocating-piston internal combustion engine.

A valve shutoff device for an internal combustion engine which includes a valve control arrangement formed of a pushrod and a rocker arm is proposed in Offenlegungsschrift No. 26 21 794, wherein a fixed rocker arm bearing in a center of the rocker arm can be adjusted by a spring means which may be brought into and out of engagement therewith so as to be elastically resilient or firm in dependence upon the predetermined operating requirements.

A control method which relies upon the cam shaft, pushrod, and rocker arm arranged laterally at the internal combustion engine only permits limited speeds since the moving masses are relatively large.

More modern internal combustion engine constructions employ cam shafts arranged at the upper portion of the engine having cams which act on respective valves by way of a short connecting lever and a cup tappet or merely by way of a cup tappet.

Such types of valve control arrangements normally permit higher speeds and also smaller constructional volumes especially where the cup tappet control makes it possible to attain high speeds due to a minimum number of structural parts.

The aim underlying the present invention essentially resides in providing a valve shutoff arrangement for a multi-cylinder internal combustion engine which arrangement utilizes small moving masses with provisions being made for an accommodation of a device for valve clearance compensation.

In accordance with the present invention, a mechanical device which includes a cup tappet with integrated conventional means for valve clearance compensation are interposed between an end of the valve stem and a valve actuating means with the mechanical device serving respectively arbitrarily in one instance as a rigid connecting member between the end of the valve stem and the valve actuating means and, in the other instance, in a closed position of the valve, eliminates a connection between the end of the valve stem and the valve actuating means.

By virtue of the above-noted features of the present invention, the cup tappet, as part of a reciprocating valve drive mechanism, may, depending upon the operating phase of the internal combustion engine, be, on the one hand, compressed and, on the other hand, be fixedly set.

In accordance with additional features of the present invention, the cup tappet is guided in a tappet housing in an axially displaceable fashion so that, the upper part of the tappet, formed as a cup, is non-rotatably supported by blocking elements which project from the tapet housing and engage in slots or grooves of the cup-shaped upper part and, a lower part of the cup tappet is adapted to mesh with an adjusting lever arranged in the tappet housing with the lower part being effective as a housing for the valve clearance compensation means. The lower part is rotatably supported in such a way that the lower tappet part and the upper tappet part cooperate in the manner of a coupling such as, for example, a rotary latch.

In accordance with one advantageous embodiment of the present invention, the valve shutoff arrangement results by providing the one-piece upper tappet part, fashioned as a cup, with tooth gaps arranged in an axial direction which gaps are engaged by teeth projecting from the one-piece lower tappet part when the valve is shuf off. Upon rotation of the lower tappet part and/or when the valve is connected, the upper tappet part constantly rests on the teeth.

Additionally, to attain a non-rotatable support of the upper tappet part simultaneously as a guidance action in an axial direction, the present invention proposes providing the grooves worked into the cylindrical portion of the upper tappet part, which grooves extend in an axial direction and are adapted to be engaged by projections of a ring fixedly mounted to the tappet housing.

In accordance with further features of the present invention, the lower tappet part, beneath the adjusting lever, may be constructed as a cup-shaped member adapted to slide along a wall of the tappet housing with a cylindrical section being surrounded by the cup which cylindrical section serves to accommodate the valve clearance mechanism.

To insure a constant direct contact between the upper tappet part and the cam on the one hand, as well as the lower tappet part and the valve stem end, on the other hand, and also to reduce the frictional forces and forces of gravity at the instant of disconnecting or connecting the valve, in accordance with the present invention, a compression spring is arranged between the bottoms of the cups of the upper tappet part and the lower tappet part with the compression spring resting directly, on the one hand, on the cup bottom of the upper part and, on the other hand, by way of a spring plate rotatably disposed on the cup bottom of the lower tappet part.

In the above-described embodiment of the present invention, a hydraulic fluid such as oil is supplied to the valve clearance compensating mechanism through a duct system disposed shortly above the valve stem end in the tappet housing.

In accordance with a further advantageous embodiment of the present invention, the duct system for the oil supplied to the valve clearance compensating mechanism is provided in an upper zone of the tappet housing with the upper tappet housing being constructed so as to be bipartite and include, in addition to a cup-shaped member, a cylindrical pressure member non-rotatably connected to the cup-shaped member. Inner teeth are arranged at the lower end of the pressure member with the inner teeth being adapted to engage the outer teeth of the lower tappet part when the valve is shut off but constantly resting on the outer teeth on the end face when the valve is connected or is operable.

In accordance with a still further feature of the present invention, the lower tappet part includes a cylindrical configuration and outer teeth of the lower tappet part are fashioned as serrated strips which extend in the axial direction and are guided so as to be longitudinally displaceable in tooth gaps of the inner teeth of the adjusting lever but are secured against rotation with respect to the latter.

In accordance with additional features of the present invention, a compression spring is arranged in the pressure member of the upper tappet part with the spring being supported, on the one hand, by way of a sliding plate which slidingly contacts the bottom of the cup and, on the other hand, by way of a cap of the valve clearance compensating means resting on the lower tappet part. This compression spring, as with the compression spring described hereinabove in connection with the first embodiment, serves, when the valve is shut off, for maintaining the upper tappet part and lower tappet part in direct contact with the end of the valve stem and with the cam.

To establish in a simple manner an oil communication between the duct system at the top and the valve clearance compensating means at the bottom, in accordance with the present invention, the pressure member of the upper tappet part is firmly surrounded by a sheet metal jacket equipped with creases which extend in the axial direction so that the jacket forms with the pressure member an annular chamber which is adapted to supply oil to the valve clearance compensating mechanism.

The creases effect an increase in a bending and buckling resistance of the component formed of the sheet metal jacket and the pressure member.

In accordance with the present invention, a switching means is provided for controlling an adjustment of the adjusting lever with the switching means being constructed as, for example, an electromagnet which simultaneously adjusts, by way of a connecting linkage preferably of the parallelogram type, the adjusting lever for the inlet valve as well as the adjusting lever for the outlet valve.

Accordingly, it is an object of the present invention to provide a valve shutoff arrangement for a multi-cylinder internal combustion engine which avoids, by simple means, shortcomings and disadvantages encountered in the prior art.

Another object of the present invention resides in providing a valve shutoff for a multi-cylinder internal combustion engine which functions reliably under all operating conditions.

A further object of the present invention resides in providing a valve shutoff for a multi-cylinder internal combustion engine which is simple in construction and therefore, relatively inexpensive to manufacture.

A still further object of the present invention resides in providing a multi-cylinder internal combustion engine with a valve shutoff by which it is possible to selectively disconnect or inactivate one or more cylinders of the engine.

Yet another object of the present invention resides in providing a multi-cylinder internal combustion engine which includes a valve shutoff by which an improved fuel consumption is realized.

Figure 2:
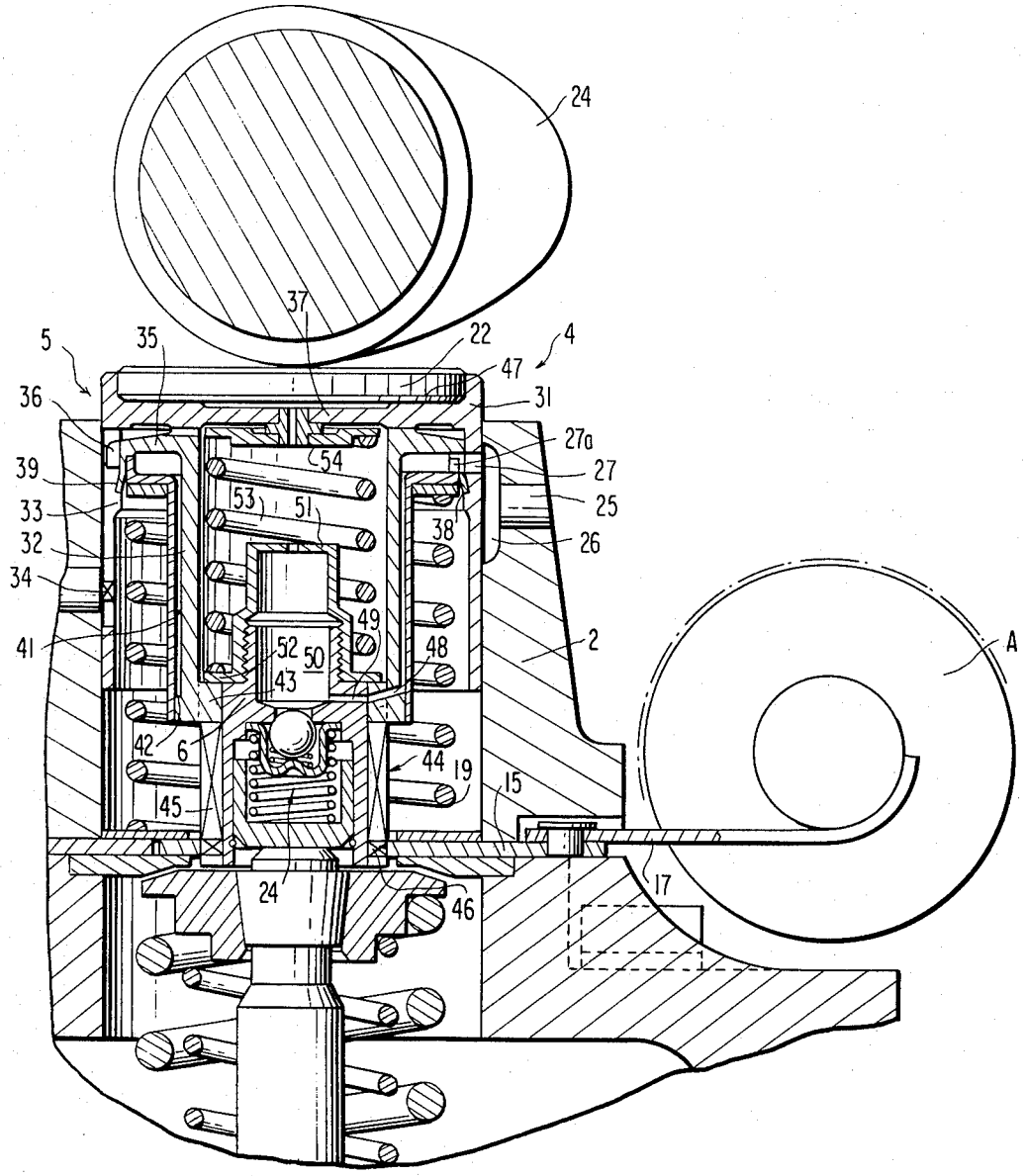

These and other objects, features, and advantages of the present invention will become more apparent from the following description when taken in connection with the accompanying drawings which show, for the purposes of illustration only, two embodiments in accordance with the present invention, and wherein:

FIG. 1 is a cross-sectional view of a first embodiment of a valve shutoff means in accordance with the present invention, wherein a valve clearance compensating mechanism is accommodated in a cup-shaped tappet; and FIG. 2 is a cross-sectional view of a second embodiment of a valve shutoff means in accordance with the present invention, with a valve clearance compensating means also accommodated in a cup-shaped tappet.

Referring now to the drawings wherein like reference numerals are used in both views to designate like parts and, more particularly, to FIG. 1, according to this figure, a multi-cylinder internal combustion engine, especially a six or eight-cylinder internal combustion engine, at least some cylinders of which are adapted to be selectively shut off by way of a valve means, includes a cylinder head generally designated by the reference numeral 3 on which is arranged a tappet housing 2 in which is longitudinally displaceable an inherently adjustable cup tappet generally designated by the reference numeral 4 of a cup tappet regulating mechanism 1.

The cup tappet 4 includes a non-rotatable one-piece upper tappet part or section 5 and a rotatable one-piece lower tappet part or section 6. The upper tappet part 5 and lower tappet part 6 each have a substantially cup shape and are adapted to slide, when the valve of the engine is connected or is operable, with their cylindrical sections or portions together in the tappet housing 2.

Grooves 8 extending in an axial direction of the tappet regulating mechanism 1 are provided in a cylindrical section 7 of the upper tappet part 5 and/or of the upper part of the cup-shaped tappet 4. The grooves 8 are adapted to accommodate projections 9 of a ring 10 so as to prevent relative rotation between the tappet housing 2 and the upper portion of the cup-shaped tappet 4 and/or upper tappet part 5. The projections 9 are in sliding contact with walls of the groove 8 with the ring 10 being fixedly attached to the tappet housing 2 so that the upper tappet part 5 is secured against rotation but not against axial movement.

A free end of the cylindrical section or part 7 of the upper tappet 5 is constructed so as to have a crown shape which includes indentations provided in the crown for defining tooth gaps 11 adapted to accommodate teeth 13 projecting from a cup bottom 12 of the lower tappet part 6. The teeth 13 are, when the associated valve is shut off, adapted to engage into the tooth gaps 11 of the upper tappet part which continues to be driven by the cam 14.

An adjusting lever 15 surrounds the teeth 13 of the lower cup-shaped tappet part 6 with the adjusting lever 15 being rotatably supported in the tappet housing 2. The adjusting lever 15 is provided with internal teeth 16 which are adapted to be engaged by the teeth 13.

The adjusting lever 15 and the lower tappet part 6 are thus connected so that they cannot rotate with respect to each other, but they are nevertheless rotatably supported in the tappet housing 2. Moreover, the lower tappet part 6 is guided to be displaceable longitudinally in the adjusting lever 15.

An actuating mechanism such as, for example, an electromagnet A is connected with the adjusting lever 15 by way of a connecting linkage 17 not shown in detail in the drawings. As soon as the adjusting lever 15 has been rotated by the electromagnet A into the illustrated position, the cylindrical section 7 of the upper tappet part 5 rests on the teeth 13 of the lower tappet part 6. The valve is connected or operative by virtue of the presently provided rigid connection.

A spring plate 18 is supported by a suitable bearing structure such as ball bearings on the cup bottom 12 of the rotatably mounted lower cup-shaped tappet part 6. The spring plate 18 serves as a counterbearing for the compression spring 19. One end of the compression spring 19, guided in the cup-shaped upper tappet part 9, rests against one end of the spring plate 18 and the other end of the compression spring 19 rests on a cup bottom 20 of the cup-shaped upper tappet part 5.

The spring plate 18 is mounted so as to be rotatable with respect to the cup bottom 12 so that a frictional moment of the tappet during a switching step is maintained at a low value.

The cup bottom 20 includes a projection or hump 21 by means of which a pressure plate 22, which rests on the cup bottom 20, is centrally guided. The cam 14 is adapted to slide along the pressure plate 22 in a conventional manner.

The lower cup-shaped tappet part 6 is provided with an interiorly positioned cylindrical section 23 which is adapted to serve as a housing for a conventional valve clearance compensating means generally designated by the reference numeral 24. An oil supply to the valve clearance compensating means 24 is effected by way of a bore 25, an oil chamber 26, a bore 27, an annular chamber 28, and a bore 29 with the oil being discharged by way of a bore 30, an oil chamber **30*a* and a bore 30*b* arranged in the lower tappet part 6**.

The disconnectable cup tappet regulating mechanism 1 illustrated in FIG. 2 also includes an inherently adjustable cup-shaped tappet 4 which includes a bipartite cup-shaped upper tappet part 5 and a one-piece lower cup-shaped tappet part 6.

The upper tappet part 5 includes a cup-shaped member 31 and a pressure member 32 supported so as to be axially displaceable with respect to the tappet housing 2. Teeth 34 extending through longitudinal slots 33 of the cup-shaped member 31 are provided for securing the upper tappet part 5 against rotation. The teeth 34 are fixedly clamped in the tappet housing 2.

The longitudinal slots 33 at the same time secure the cylindrically-shaped pressure member 32 disposed within the cup-shaped member 31 against rotation since teeth 36, arranged at a top shoulder 35 of the pressure member 32, also engage into the longitudinal slots 33.

The pressure member 32 disposed within the cup-shaped member 31 and contacting a cup bottom 37 is secured against longitudinal displacement by rolling a free end 38 of the shoulder 35 into an annular groove 39 provided in the cup-shaped member 31.

The pressure member 32 is surrounded by a thin-walled sheet metal jacket 40 which is provided with creases which extend in an axial direction. The jacket 40 is connected at upper and lower ends with the pressure member 32 so that the jacket 40 and pressure member 32 form a closed annular chamber 41 which serves as an inlet pressure oil reservoir for the valve clearance compensating means 24 accommodated in the lower tappet part 6.

The pressure member 32 is provided at a lower end with an externally located collar 42 and with an inwardly disposed toothed section 43. The externally located collar 42 is contacted by the sheet metal jacket 40. The inwardly disposed toothed section 43, when the valve is shut off, meshes with outer teeth 44 provided at the lower tappet part 6.

The cylindrically shaped lower tappet part 6 serves as a housing for accommodating the valve clearance compensating means 24 with the outer surface of the cylindrically shaped lower tappet part 6 being provided with teeth 45 extending in an axial direction in the manner of a strip and being guided in a lower zone into tooth gaps 46 of internal teeth of the adjusting lever 15 so that they are longitudinally displaceable but non-rotatable with respect to the adjusting lever 15.

The adjusting lever 15 surrounding the lower tappet part 6 is rotatably supported in the tappet housing 2 and is actuated by an electromagnet A by way of a connecting linkage 17 not shown in detail.

The inlet valve of the respective cylinders of the internal combustion engine is articulated to the connecting linkage 17 so as to obtain a simultaneous connection or shut off of the respective valves.

When the valve is connected, which is only possible when the valve is closed, the adjusting lever 15 is rotated by the electromagnet A and therewith also the lower tappet part 6 so that the teeth of the pressure member 32 can no longer engage or be inserted into the tooth gaps of the lower tappet part 6 but rather, the teeth contact end faces of the strip-like or ledge-like teeth 35 as shown in FIG. 2.

The cup-shaped member 31 is provided with an annular centering means 47 for a pressure plate 22. By virtue of a snug fit, it is possible for the pressure plate 22 to rotate whereby a uniform wear and longer running time are made possible.

A compression spring 19 is disposed between the cup member 31 and the sheet metal jacket 40 so as to take into account a constant direct contact between the upper tappet part 5/cam 24 and the lower tappet part 6/valve stem end. Oil is supplied to the hydraulic valve clearance compensating means 24 by way of a bore 25, an oil chamber 26 in the tappet housing 2, as well as by way of holes or openings 27, **27*a* in the cup-shaped member 31 and pressure member 32, an annular chamber 41 and, by ducts 48, 49, arranged in the pressure member 32 and in the lower tappet part 6, to be collected in an oil chamber 50 which is sealed by a cap-shaped hood 51**.

A rim 52 of the hood 51 serves as a spring abutment for a compression spring 53. The compression spring 53 rests at a position opposite the abutment with the rim 52, on a spring plate 54 rotatably provided on the cup bottom 20 so that the frictional moment at the tappet is kept at a low value during a switching operation.

A rear side of the rim 52 is simultaneously effective as a stop for limiting a stroke of the upper tappet part 5 and/or the interiorly guided compression spring 53 so as to prevent the spring 53 from exerting, in a base circle phase of the cam 24, a force on the cam 24.

While we have shown and described only two embodiments in accordance with the present invention, it is understood that the same is not limited thereto, but is susceptible of numerous changes and modifications as known to one having ordinary skill in the art, and we therefore do not wish to be limited to the details shown and described herein, but intend to cover all such changes and modifications as are encompassed by the scope of the appended claims.

We claim:

1. A multi-cylinder internal combustion engine which includes valve means for respective cylinders of the engine and means for selectively shutting off a valve means of at least one of the cylinders, the valve means including a valve stem and a valve actuating cam means, characterized in that means are interposed between an end of the valve stem and the valve actuating cam means for selectively directly rigidly mechanically connecting or disconnecting an end of the valve stem relative to the valve actuating cam means in dependence upon a positioning of the valve means.

2. A multi-cylinder internal combustion engine according to claim 1, characterized in that the valve means is displaceable between an open and closed position, and in that said connecting and disconnecting means are effective to disconnect the valve stem from the valve actuating means when the valve means is in the closed position.

3. A multi-cylinder internal combustion engine according to claim 2, characterized in that said connecting and disconnecting means includes a cup-shaped tappet means arranged between an end of the valve stem and the valve actuating cam means.

4. A multi-cylinder internal combustion engine according to claim 3, characterized in that said connecting and disconnecting means includes one valve clearance compensation means.

5. A multi-cylinder internal combustion engine according to claim 4, characterized in that the cup-shaped tappet means is axially displaceably guided in a tappet housing means, the cup-shaped tappet means includes an upper cup-shaped tappet portion and a lower cup-shaped tappet portion, means are provided for mounting the upper tappet portion so as to be non-rotatable with respect to the tappet housing means, an adjusting lever means is operatively connected with the lower tappet portion, the upper tappet portion and lower tappet portion are arranged in the tappet housing means in such a manner that they form a coupling.

6. A multi-cylinder internal combustion engine according to claim 4, characterized in that the coupling formed is a rotary latch.

7. A multi-cylinder internal combustion engine according to claim 5, characterized in that said mounting means includes blocking means provided on one of the upper tappet portion and the tappet housing means, and means for receiving the blocking means provided on the other of the upper tappet portion and the tappet housing means.

8. A multi-cylinder internal combustion engine according to claim 7, characterized in that the blocking means includes projections provided at the tappet housing means and the receiving means includes slot means provided in the upper tappet portion for accommodating the projections.

9. A multi-cylinder internal combustion engine according to claim 8, characterized in that the valve clearance compensating means is accommodated in the lower tappet portion.

10. A multi-cylinder internal combustion engine according to one of claims 5, 7, or 8, characterized in that the lower tappet portion is provided with axially projecting teeth, the upper tappet portion is provided with axially extending tooth gaps for accommodating the teeth of the lower tappet portion, the teeth being inserted into the tooth gaps when an associated valve means is shut off, and in that, upon one of a rotation of the lower tappet portion and connection of the associated valve means, the upper tappet portion is constantly at rest at the teeth of the lower tappet portion.

11. A multi-cylinder internal combustion engine according to claim 10, characterized in that the upper tappet portion includes a cylindrical section, the groove means are worked into the cylindrical section, and in that the projections are disposed on a ring member fixedly arranged at the tappet housing means.

12. A multi-cylinder internal combustion engine according to claim 11, characterized in that the lower tappet portion, at a position below the adjusting lever means, includes a cup sliding along an inner wall of the tappet housing means, and a cylindrical section surrounded by the cup, the cylindrical section serving for an accommodation of a valve clearance compensating means.

13. A multi-cylinder internal combustion engine according to claim 12, characterized in that the upper tappet portion and lower tappet portion each include bottom wall members, a compression spring is arranged between the respective bottom wall members, the compression spring having a first end resting directly on the bottom wall member of the upper tappet part, and a second end resting on the bottom wall member of the lower tappet part, and in that means are provided for rotatably mounting the second end of the compression spring at the lower tappet portion.

14. A multi-cylinder internal combustion engine according to claim 13, characterized in that said means for rotatably mounting the second end of the compression spring includes a spring plate means arranged between the second end of the compression spring and the lower tappet portion.

15. A multi-cylinder internal combustion engine which includes valve means for respective cylinders of the engine and means for selectively shutting off a valve means of at least one of the cylinders, the valve means includes a valve stem and a valve actuating means, characterized in that means are interposed between an end of the valve stem and the valve actuating means for selectively rigidly connecting or disconnecting an end of the valve stem relative to the valve actuating means in dependence upon a positioning of the valve means, the valve means is displaceable between an open and closed position, said connecting and disconnecting means are effective to disconnect the valve stem from the valve actuating means when the valve means is in the closed position, said connecting and disconnecting means includes a cup-shaped tappet means arranged between an end of the valve stem and the valve actuating means and one valve clearance compensation means, the cup-shaped tappet means includes an upper cup-shaped tappet portion and a lower cup-shaped tappet portion, the upper tappet portion is of a bipartite construction and includes a cup member and a cylindrical pressure member, means are provided for connecting the pressure member for rotation with the cup member, the pressure member is provided with an inner toothed means disposed along a lower end thereof which are adapted to engage outer toothed means provided along the lower tappet portion, and in that the toothed means of the pressure member are adapted to constantly rest on an end face of the outer toothed means of the lower tappet portion when the valve means is shut off.

16. A multi-cylinder internal combustion engine according to claim 15, characterized in that an adjusting lever means is operatively connected with the lower tappet portion, the lower tappet portion is of a cylindrical cross-sectional configuration, the outer toothed means of the lower tappet portion is formed from tooth-like strips being adapted to be longitudinally displaceably guided in tooth gaps of an inner toothing of the adjusting lever means, and in that the tooth-like strips are secured against rotation with respect to the adjusting lever means.

17. A multi-cylinder internal combustion engine according to claim 16, characterized in that a compression spring means is arranged in the pressure member, means are provided for slidably supporting a first end of the compression spring means at the cup member, a second end of the compression spring means is seated on the lower tappet portion.

18. A multi-cylinder internal combustion engine according to claim 17, characterized in that the means for slidably supporting a first end of the compression spring means includes a sliding plate adapted to be brought into a sliding contacting engagement with a bottom wall member of the cup member.

19. A multi-cylinder internal combustion engine according to claim 18, characterized in that a valve clearance compensating means is accommodated in the lower tappet portion.

20. A multi-cylinder internal combustion engine according to claim 17, characterized in that a jacket means is provided for firmly surrounding the pressure member of the upper tappet portion, the jacket means being provided with axially extending creases disposed so as to form an annular space with the pressure member which annular space is adapted to accommodate an oil supply for a valve clearance compensating means.

21. A multi-cylinder internal combustion engine according to one of claims 5, 7, 10, 16, 17, or 20, characterized in that means are provided for selectively adjusting the adjusting lever means, and in that linkage means are provided for operatively connecting the adjusting means with the adjusting lever means.

22. A multi-cylinder internal combustion engine according to claim 21, wherein said adjusting means includes an electromagnet.

23. A multi-cylinder internal combustion engine according to claim 22, characterized in that the valve means form inlet and outlet valves of the engine, and in that means are provided for connecting the adjusting lever means with the inlet and outlet valves so as to permit a simultaneous adjustment thereof.

* * * * *